US007051683B1

(12) United States Patent
Lee et al.

(10) Patent No.: US 7,051,683 B1
(45) Date of Patent: May 30, 2006

(54) GAS HEATING DEVICE CONTROL

(75) Inventors: Hyungsik Lee, Port Washington, WI (US); Robert F. Poehlman, Jr., South Milwaukee, WI (US)

(73) Assignee: AOS Holding Company, Wilmington, DE (US)

( * ) Notice: Subject to any disclaimer, the term of this patent is extended or adjusted under 35 U.S.C. 154(b) by 0 days.

(21) Appl. No.: 11/205,673

(22) Filed: Aug. 17, 2005

(51) Int. Cl.
*F23N 5/12* (2006.01)

(52) U.S. Cl. ..... 122/14.21; 431/75; 431/76; 431/78

(58) Field of Classification Search ..... 122/14.21, 122/14.2; 431/2, 12, 25, 75, 76, 78
See application file for complete search history.

(56) References Cited

U.S. PATENT DOCUMENTS 4,125,356 A 11/1978 Ohashi et al.
4,325,691 A * 4/1982 Evans et al. ..... 431/190
4,358,265 A 11/1982 Tanaka et al.
4,428,726 A 1/1984 Kimpara et al.
4,638,789 A 1/1987 Ueki et al.
4,682,946 A 7/1987 Kasada
5,049,063 A 9/1991 Kishida et al.
5,347,982 A 9/1994 Binzer et al.
5,899,683 A 5/1999 Nolte et al.
5,971,745 A 10/1999 Bassett et al.
6,299,433 B1 10/2001 Gauba et al.
6,561,138 B1 5/2003 Kobayashi et al.

OTHER PUBLICATIONS

P. H. Gerhardt and K.H. Homann, Ions and Charged Soot Particles in Hydrocarbon Flames, Combustion and Flame Journal, vol. 81, Nos. 3 and 4, pp. 289-303, Sep. 1990.
R. Sonnemann and M. Hoppe, Combustion Control System for Varying Gas Qualities, 1998 International Gas Research Conference, pp. 84-94.

* cited by examiner

*Primary Examiner*—Gregory Wilson
(74) *Attorney, Agent, or Firm*—Michael Best & Friedrich LLP

(57) ABSTRACT

A method, and a system using the method, of controlling a heating device. The method includes combusting a mixture of fuel and air in a sealed combustion chamber thereby forming a reaction zone in which the fuel reacts with the air, and also forming outside of the reaction zone an ion zone in which ions are formed as a result of combustion. The method also includes positioning an ion detecting member in the ion zone, and generating an electrical signal at the ion detecting member in response to an ion concentration in the ion zone. The method also includes detecting a direction reversal of the electrical signal at the ion detecting member, and stopping combusting the mixture in response to the reverse of the direction of the electrical signal.

20 Claims, 4 Drawing Sheets

GAS HEATING DEVICE CONTROL

BACKGROUND

The invention relates to heating devices, and particularly, to gas heating devices. More particularly, the invention relates to control of gas heating devices.

Gas-fired heating devices such as water heaters often include a combustion chamber and air plenum disposed below a water tank. A gas manifold tube, an ignition source, a thermocouple, and a pilot tube typically extend into the combustion chamber. When the temperature of the water in the tank falls below a set minimum, gas fuel is introduced into the combustion chamber through the gas manifold tube and a burner element. This gas fuel is ignited by a pilot flame or the ignition source, and the flame is maintained around the burner element. Air is drawn into the plenum via an air inlet, and mixes with the gas fuel to support combustion within the combustion chamber. The products of combustion typically flow through a flue or heat exchange tube in the water tank to heat the water by conduction.

These gas-fired heating devices are often subjected to abnormal combustion conditions. For example, some water heaters are often positioned in areas that are also occupied by other equipment that has a gasoline-powered internal combustion engine. In such cases, it is not uncommon that there be gasoline and other flammable substances (e.g., kerosene, diesel, turpentine, solvents, alcohol, propane, methane, and butane) present in the same area. Such flammable substances often emit flammable vapors. Other foreign objects in the areas such as lint, dust, and oil ("LDO") can also be introduced to the air inlet during the combustion. The foreign objects will accumulate and eventually block portions of the air inlet. A blocked air inlet can reduce the amount of air needed for stoichiometric combustion.

SUMMARY

In one form, the invention provides a method of controlling a heating device that has a sealed combustion chamber. The method includes combusting a mixture of fuel and air in the sealed combustion chamber thereby forming a reaction zone in which the fuel reacts with the air, and also forming outside of the reaction zone an ion zone in which ions are formed as a result of combustion. The method also includes positioning an ion detecting member in the ion zone, and generating an electrical signal at the ion detecting member in response to an ion concentration in the ion zone. The method also includes detecting a direction reversal of the electrical signal at the ion detecting member, and stopping combusting the mixture in response to the direction reversal of the electrical signal.

In another form, the invention provides a method of controlling a heating device that has a sealed combustion chamber. The method includes introducing an amount of fuel into the heating device, and combusting a mixture of the fuel and air in the sealed combustion chamber thereby forming a reaction zone, and also forming outside of the reaction zone an ion zone in which ions are formed as a result of combustion. The method also includes detecting an ion formation in the ion zone, and converting the detected ion formation into an electrical signal. The method also includes detecting a direction reversal of the electrical signal, and stopping combusting the mixture in response to the direction reversal of the electrical signal.

In still another form, the invention provides a heating device that includes a sealed combustion chamber that has an air inlet such that substantially all air entering the combustion chamber passes through the inlet. The heating device also includes a tube to introduce fuel into the combustion chamber. The heating device also includes a burner in the combustion chamber. The burner receives the fuel via the tube and the air via the air inlet, and combusts the fuel and the air in the sealed combustion chamber thereby forming a reaction zone in which the fuel reacts with the air, and also forming outside of the reaction zone an ion zone in which ions are formed as a result of combustion. An ion detecting member in the ion zone generates an electrical signal in response to an ion concentration in the ion zone. A controller is configured to receive the electrical signal from the ion detecting member, to detect a direction reversal of the electrical signal, and to shut the tube in response to the direction reversal of the electrical signal.

In hydrocarbon-air flames, ions are produced by chemical-ionization in oxidation zones and thermal ionization of soot. When there is a significant reduction in combustion air below stoichiometric conditions, an addition of foreign substances in the flames, positively charged soot particles and polyhedral carbon ions are produced. As a result, ion concentrations above the main reaction zone drastically increase. In this way, the electric signals transmitted through the ion detecting member can be used in interrupting, terminating, or stopping an operation of the gas heating device before CO level in the flue outlets reaches a preset level. Unlike other sensors, the invention uses an ion detecting member to directly detect a property of the flame associated with incomplete combustion and foreign objects burning. Therefore, reliable and accurate detection of high CO formation is achieved, regardless of the types of sources and operating conditions. In addition, the electrical signals are not affected by the vent pipe configuration and there is no delay in its response time.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Embodiments of the invention provide a method of controlling a heating device that has a sealed combustion chamber. The method includes combusting a mixture of fuel and air in the sealed combustion chamber thereby forming a reaction zone in which the fuel reacts with the air. The method also includes spacing an ion detecting member apart from the reaction zone, and generating an electrical signal at the ion detecting member in response to an ion concentration adjacent the ion detecting member. The method also includes detecting a direction reversal of the electrical signal at the ion detecting member, and stopping combusting the mixture in response to the reverse of the direction of the electrical signal.

Figure 1:
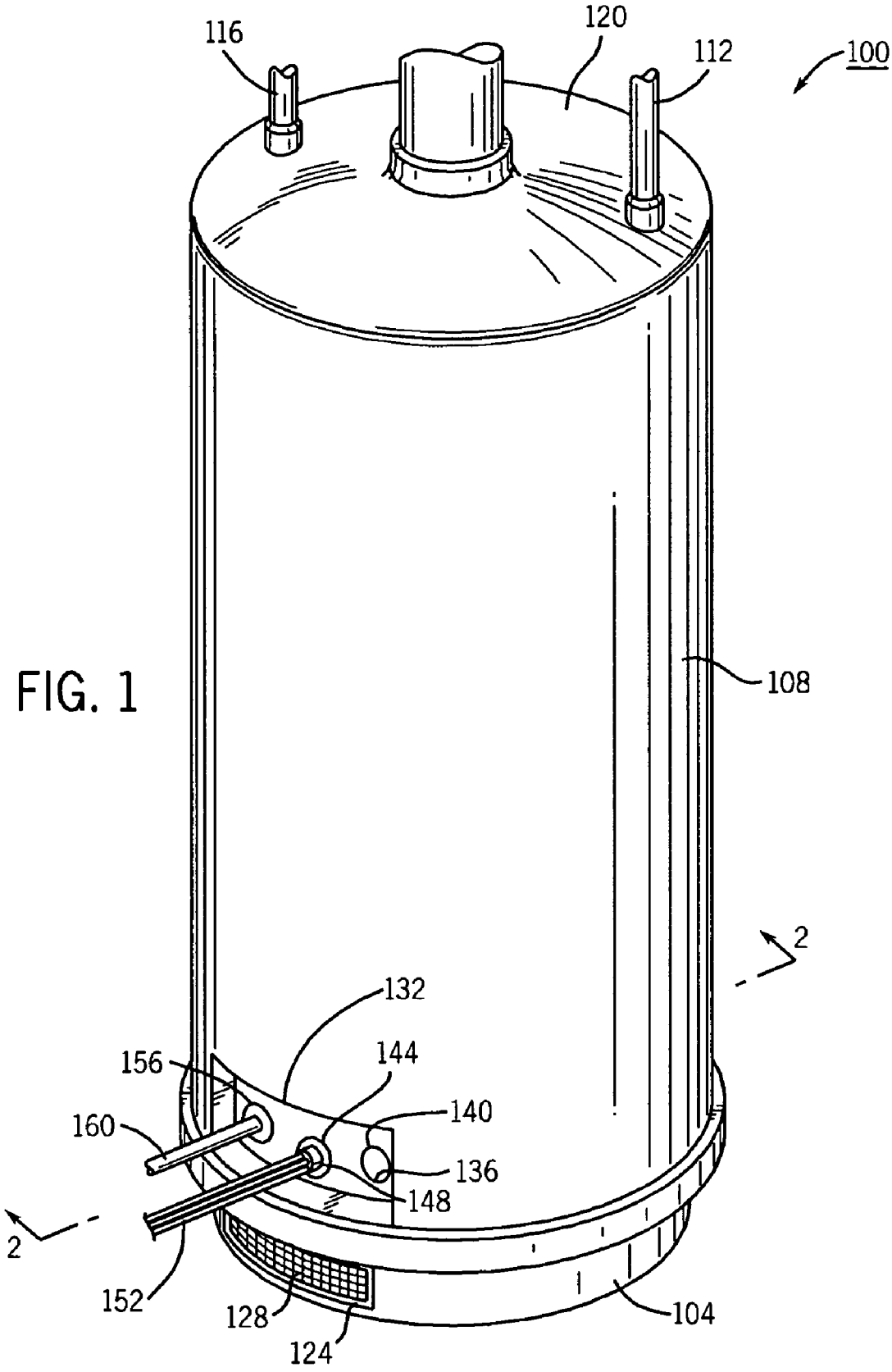
FIG. 1 is a perspective view of a water heater.

FIG. 1 illustrates a storage type gas-fired water heater 100 including a base pan 104 supporting an outer jacket 108. The base pan 104 may be constructed of stamped metal or plastic. Water pipes 112, 116 communicate with the water heater 100 through a top head 120. The base pan 104 includes an air intake aperture or air inlet 124 that is covered by a screen 128. The screen 128 is typically made of wire mesh material that acts as a lint, dust, and oil ("LDO") screen to minimize the amount of undesired foreign particles entering the water heater 100.

The outer jacket 108 includes an access door 132 that includes a variety of apertures. First aperture 136 has a sight glass 140 to permit viewing of a pilot light of the heater 100. Second aperture 144 includes a grommet 148 that has channels or holes through which various burner operating conduits, such as wires and tubes 152 (for example, an ignition wire, a thermocouple lead and a pilot light tube) extend into the interior of the water heater 100. Third aperture 156 accommodates a gas manifold tube 160 that extends into the interior of the heater 100.

Figure 2:
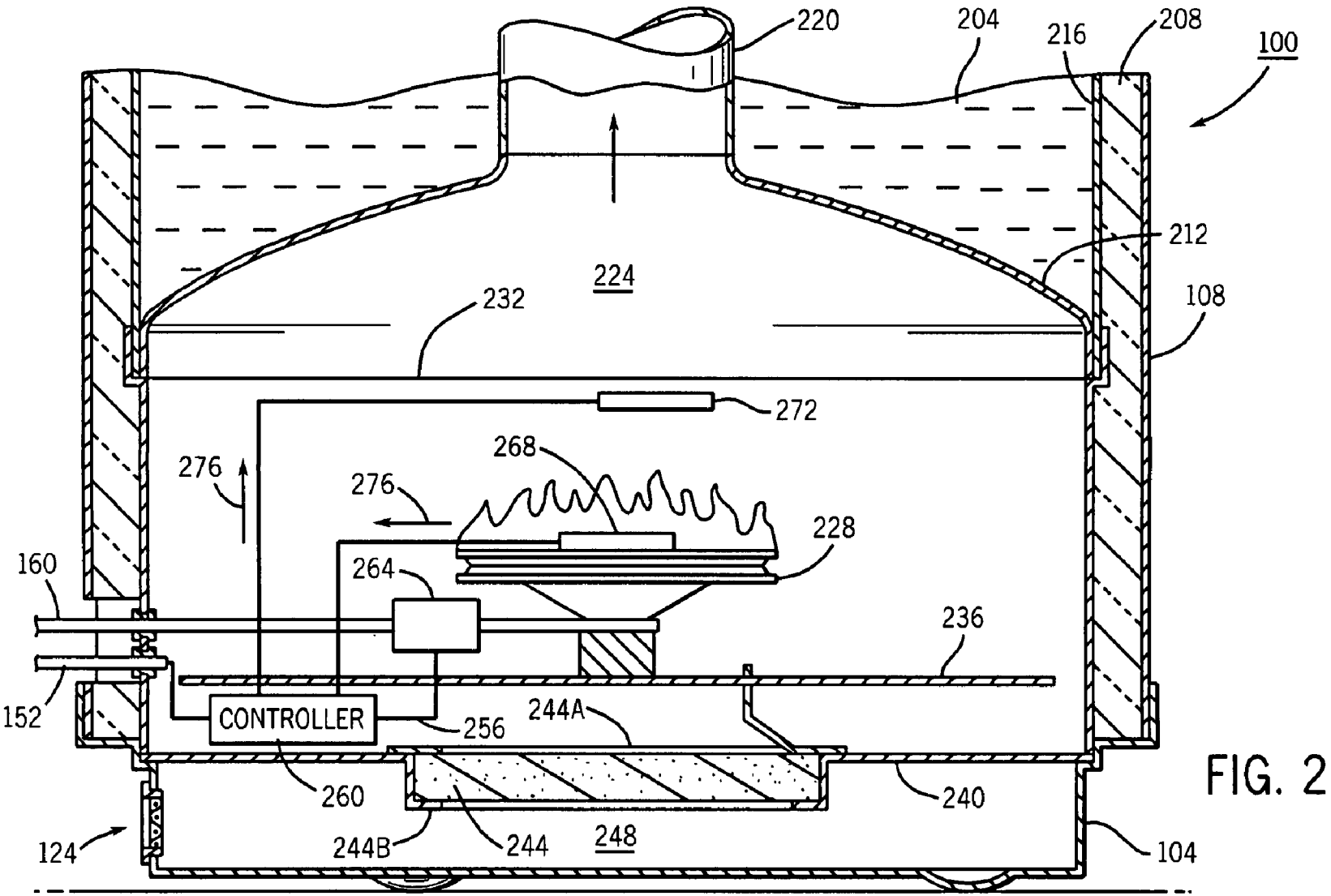
FIG. 2 is a cross-section view of the bottom portion of the water heater of FIG. 1.

FIG. 2 best illustrates a cross section view of the interior of the water heater 100 cut about line 2—2 in FIG. 1. The water heater 100 includes a water tank 204 that is supported by the base pan 104, and insulation 208 surrounding the tank 204. The tank 204 is defined by a tank bottom head 212 and a side wall 216, and the top head 120. A flue 220 extends from the tank bottom head 212 up through the tank 204. Water in the tank 204 surrounds the flue 220. The bottom of the water heater 100 defines a combustion chamber 224 having therein a burner 228. The water heater 100 also includes a seal 232 and a radiation shield 236.

The water heater 100 also includes a flame arrester support 240 that supports a flame arrester 244. The flame arrester 244 has an upper surface 244A and a lower surface 244B. The flame arrester 244 permits substantially all flammable vapors that are within flammability limits to burn near its top surface 244A while preventing substantially all flames from passing from the top surface 244A through the flame arrester 244 out the bottom surface 244B, and into an air plenum 248 defined by the base pan 104 and flame arrester support 240. The flame arrester 244 is constructed of materials that resist thermal conduction from the upper surface 244A to the lower surface 244B to further reduce the likelihood of ignition of flammable vapors in the air plenum 248. The combustion chamber 224 is substantially air-tight except for its communication with the flue 220 and flame arrester 244. In this regard, the water heater 100 may be termed a "sealed combustion" water heater.

Although a conventional pancake-style gas burner is illustrated in FIG. 2, the invention can also be applied to a device employing substantially any type of gas burner, including: fully or partially aerated burners; diffuse burners; infrared burners; blue flame burners; premix flame burners; burners made of metallic, ceramic, or other electrically-conductive or non-conductive materials. Some pre-mix burners actually perform both the burner and flame arrester functions with one element. For the purposes of this written description, the term "burner" is intended to include all of the above-mentioned types of burners and any other type of burner that might be used in a gas appliance in which the control system described below is useful or desirable.

Theoretically complete combustion is achieved in a burner when the ratio of air to fuel is stoichemetric. The variance of the air-to-fuel ratio from the stoichemetric ratio for a given fuel is reflected in the value lambda or $\lambda$. When $\lambda$ equals 1, the air-to-fuel ratio for a given fuel is at its stoichemetric value. When $\lambda$ is below 1, the air-to-fuel ratio for a given fuel is less than its stoichemetric value (e.g., when $\lambda$ equals 0.9, there is only 90 percent of the air needed for theoretically complete combustion of the given fuel). When $\lambda$ is above 1, the air-to-fuel ratio for a given fuel is greater than its stoichemetric value (e.g., when $\lambda$ equals 1.1, there is 110 percent of the air needed for theoretically complete combustion of the given fuel).

The value of $\lambda$ can decrease through a decrease in air or an increase in fuel supplied to the burner 228. The supply of air to the burner 228 may be decreased as a result of LDO accumulating on the screen 124 and blocking air flow into the air plenum 248 and combustion chamber 224. The supply of fuel may be increased as a result of excess hydrocarbons (e.g., as a result of flammable vapors migrating into the combustion chamber 224, or as a result of contaminants such as oil being entrained in the fuel gas supply) in the combustion chamber 224. Regardless of whether the supply of air is decreased or the supply of fuel is increased, if the value of $\lambda$ drops below 1, there is likely inefficient and incomplete combustion.

In the embodiment illustrated in FIG. 2, a wire 256 operatively interconnects a controller 260 to a gas valve 264 that is controlled by the controller 260. Although illustrated as being within the combustion chamber 224, the controller 260 and/or gas valve 264 may in other embodiments be positioned outside of the combustion chamber 224. All gas fuel flowing through the manifold tube 160 to the burner 228 flows through the gas valve 264. Consequently, operation of the burner 228 will cease in the event the controller 260 closes the gas valve 264. In the event the burner 228 is of the type that utilizes a pilot burner and thermocouple, the gas valve 264 may also be closed (either directly in response to the thermocouple cooling or through a signal generated by the controller 260 in response to the thermocouple cooling) in the event the thermocouple does not sense a pilot flame on the pilot burner. In such constructions, shutting off the gas fuel supply through the manifold 160 will also shut off gas fuel supply to the pilot burner. The controller 260 closes the gas valve 264 in response to a condition arising in the combustion chamber 224 that is indicative of $\lambda$ dropping below 1.

More specifically, in the construction illustrated in FIG. 2, the controller 260 is connected in circuit to first and second detecting members 268, 272. The first and second detecting members 268, 272 each comprise substantially any electrically-conductive member, such as an electrical, metallic, or conductive rod, or a so-called "flame rod." The first detecting member 268 is within the main reaction zone of the burner flame, and the second detecting member 272 is above the main reaction zone (an area referred to herein as the "ion zone"). For example, the second detecting member 272 may be positioned about half an inch to about five inches from the burner 228. Alternatively, depending on applications and the burner type, the second detecting member 272 can be positioned at other locations above the burner 228, either within the combustion chamber 224 or even within the flue 220, wherever ion concentrations are sufficient for the control system to operate as described below. The first detecting member 268 is used in this control system to establish a base voltage for comparison with the voltage generated at the second detecting member 272.

As the burner 228 operates under normal conditions, it generates different concentrations of ions in the areas surrounding the first and second detecting members 268, 272. First and second electrical signals are generated within the respective first and second detecting members 268, 272 (i.e., the first and second detecting members 268, 272 are poles). The controller 260 measures a potential voltage difference between the first and second detecting members 268, 272. Under normal combustion conditions (i.e., when λ is equal to or greater than 1), the ion concentration in the main reaction zone is high compared to the ion concentration surrounding the second detecting member 272. As a result, the first detecting member 268 is relatively positively charged when compared to the second detecting member 272, and the direction of electrons flowing between the first and second detecting members 268, 272 is characterized by arrows 276.

Figure 3:
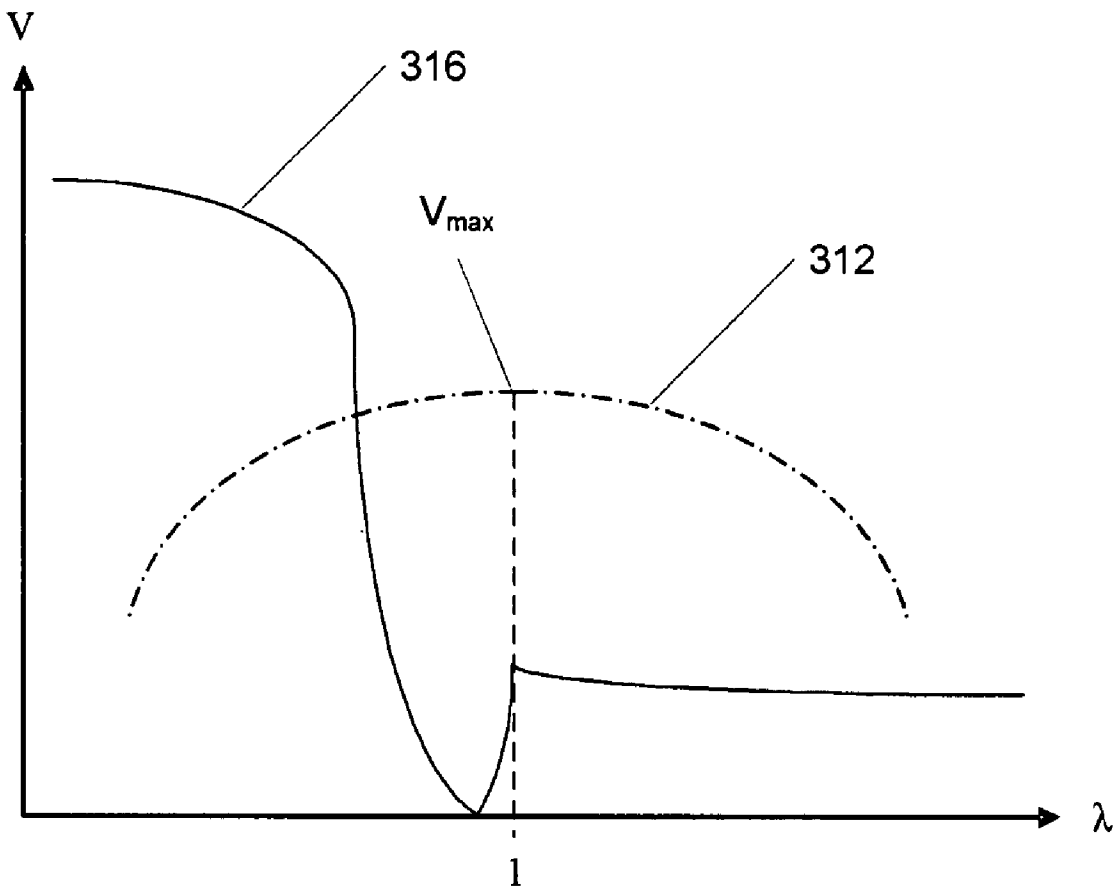
FIG. 3 is a plot of an ionization voltage as a function of air-to-fuel ratio.

FIG. 3 is a plot of the absolute value of the voltage in the respective first and second detecting members 268, 272 against λ. Curve 312 shows how voltage varies with λ in the first detecting member 268, and curve 316 shows how voltage varies with λ in the second detecting member 272. It will be seen that voltage in the first detecting member 268 is maximized when λ equals 1, and becomes less than 1 when λ increases and decreases. On the other hand, it will be seen that voltage in the second detecting member 272 is generally stable when λ is equal to or greater than 1, but drops dramatically when λ is less than 1. In fact, voltage continues to decrease below zero and becomes more and more negative as λ drops further and further below 1 (the plot in FIG. 3 is the absolute value, and consequently shows the voltage as becoming larger after reaching zero, even though it is in reality becoming a larger negative number). In this regard, the voltage in the second detecting member 272 actually changes direction (i.e., flows in the direction opposite arrows 276) if λ drops too far below 1. Thus, a change in direction of the voltage or current in the circuit defined by the first and second detecting members 268, 272 and the controller 260 is indicative of inefficient, incomplete combustion.

Figure 4:
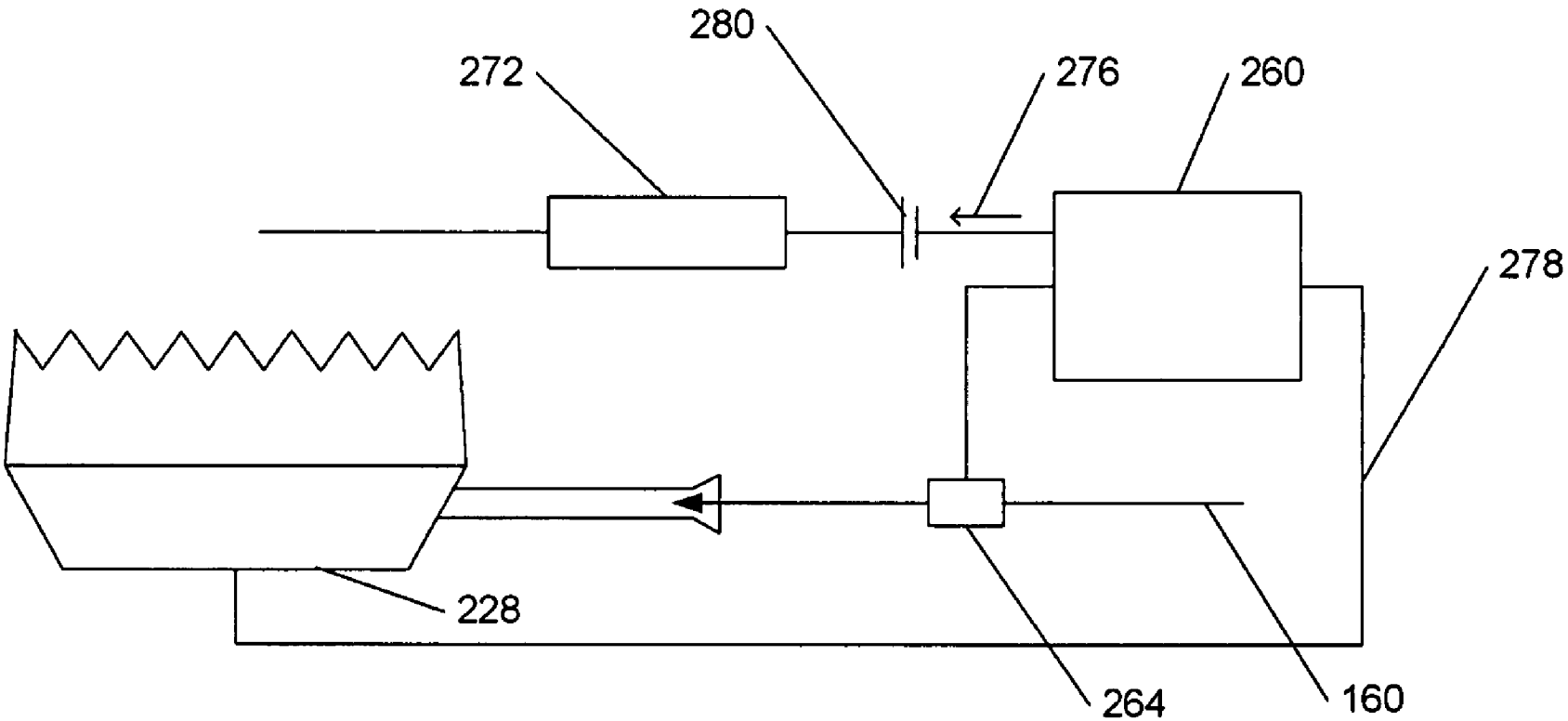
FIG. 4 is a block diagram of another construction of the control system.

FIG. 4 schematically illustrates another construction of the control system. In this construction, the controller 260 is connected in circuit between the burner 228 and the second detecting member 272 (i.e., the first detecting member 268 is removed and the controller 260 is wired to the burner 228 with wire 278). In this construction, the burner 228 provides a base voltage or ground against which the voltage in the second detecting member 272 is measured (i.e., the burner 228 and second detecting member 272 are poles). The same phenomenon as described above is realized at the second detecting member 272 in this construction, and a change in direction of voltage or current is indicative of inefficient, incomplete combustion. The circuit illustrated in FIG. 2 is most useful when the burner 228 is of a type that is not metallic or is otherwise not electrically conductive or is electrically insulated. If the burner 228 is electrically conductive, the circuit illustrated in FIG. 4 may be employed, as the burner 228 may be incorporated into the circuit.

A voltage biasing member 280 may be used in either of the circuits illustrated in FIGS. 2 and 4. The voltage biasing member 280 is useful when measuring impedance as the electrical signal monitored by the controller 260. The biasing member 280 is also useful when stronger electrical signal is needed for the controller. The biasing member 280 may include, for example, a thermopile.

In either of the embodiments illustrated in FIGS. 2 and 4, the controller 260 interprets a reversal of the electrical signal as λ dropping below 1 and as an occurrence of incomplete combustion (regardless of whether the incomplete combustion is caused by insufficient air supply, the presence of too many hydrocarbons, or contaminants in the fuel). The controller 260 then shuts down further combustion by closing the gas valve 264. The control system therefore eliminates the need for a thermal cutoff ("TCO") switch below the burner 228 (used in some cases to detect a severe reduction in air) or a hydrocarbon sensor above the burner 228 (to detect the presence of hydrocarbons in the combustion chamber 224) because the control system can perform the functions of both sensors.

The above-described embodiments also do not rely solely on an ion detection member or a metallic rod positioned in the reaction zone. Rather, they utilize the ion detection member outside of the reaction zone. One advantage of the above-described control system is that it monitors the direction of the electrical signal (which may be, for example, voltage, current, impedance) rather than the strength of the signal (which is often the case in existing control systems). This reduces the likelihood of false shut-downs that can happen in existing systems when the flame rod in the main reaction zone becomes contaminated and the signal drops (if voltage or current) or increases (if impedance). The direction of the signal is a unique characteristic that is not affected by contamination of the ion detection member.

Thus, the invention provides, among other things, a control system for use with a heating device. Various features and advantages of the invention are set forth in the following claims.

What is claimed is:

1. A method of controlling a heating device having a sealed combustion chamber, the method comprising:

combusting a mixture of fuel and air in the sealed combustion chamber thereby forming a reaction zone in which the fuel reacts with the air, and also forming outside of the reaction zone an ion zone in which ions are formed as a result of combustion;

positioning an ion detecting member in the ion zone;

generating an electrical signal at the ion detecting member in response to the concentration of ions in the ion zone;

detecting a reversal of the electrical signal at the ion detecting member; and stopping combustion in response to detecting the reversal of the electrical signal.

2. The method of claim 1, wherein the positioning step includes positioning at least one of a metallic rod and a conductive rod in the ion zone.

3. The method of claim 1, wherein combusting the mixture comprises combusting the mixture in a burner, and wherein the positioning step includes positioning the ion detecting member between about 0.5 and 5 inches away from the burner.

4. The method of claim 1, wherein the detecting step includes detecting a direction reversal of at least one of a voltage signal and a current signal.

5. The method of claim 1, wherein the combustion step includes comprising a portion of the reaction zone of at least one of non-aerated flame, partially aerated flame, fully aerated flame, premixed flame, and diffuse flame.

6. The method of claim 1, further comprising:

positioning a second ion detecting member in the reaction zone;

generating a second electrical signal at the second ion detecting member in response to an ion concentration adjacent the second ion detecting member; and comparing the first electrical signal with the second electrical signal.

7. The method of claim 1, further comprising:

providing an electrical bias source at the ion detecting member; and comparing a signal of the electrical bias source with the electrical signal.

8. A method of controlling a heating device having a sealed combustion chamber, the method comprising:

introducing an amount of fuel into the heating device;

combusting a mixture of the fuel and air in the sealed combustion chamber thereby forming a reaction zone, and also forming outside of the reaction zone an ion zone in which ions are formed as a result of combustion;

detecting an ion formation in the ion zone;

converting the detected ion formation into an electrical signal; and detecting a direction reversal of the electrical signal.

9. The method of claim 8, wherein the detecting step includes detecting the ion formation in the ion zone with at least one of a metallic rod and a conductive rod.

10. The method of claim 8, wherein the detecting step includes detecting the ion formation from about 0.5 to 5 inches away from the burner.

11. The method of claim 8, wherein the detecting step includes detecting a reversal of at least one of a voltage signal and a current signal.

12. The method of claim 8, wherein the combustion step includes comprising a portion of the reaction zone comprises at least one of non-aerated flame, partially aerated flame, fully aerated flame, premix flam, and diffusion flame.

13. The method of claim 8, wherein the electrical signal comprises a first electrical signal, the method further comprising:

detecting a second ion formation in the reaction zone;

converting the second detected ion formation into a second electrical signal; and comparing the first electrical signal with the second electrical signal.

14. The method of claim 8, further comprising:

biasing the electrical signal; and comparing the biased electrical signal with the electrical signal.

15. A heating device comprising:

a sealed combustion chamber;

a supply of gas fuel;

a burner in the combustion chamber adapted to combust a mixture of the gas fuel and air in the sealed combustion chamber thereby forming a reaction zone in which the fuel reacts with the air, and also forming outside of the reaction zone an ion zone in which ions are formed as a result of combustion;

an ion detecting member mounted in the ion zone, and adapted to generate an electrical signal in response to the concentration of ions in the ion zone; and a controller adapted to receive the electrical signal from the ion detecting member, to detect a direction reversal of the electrical signal, and to disrupt the supply of gas fuel to the burner in response to the direction reversal of the electrical signal.

16. The device of claim 15, wherein the ion detecting member comprises at least one of a metallic rod and a conductive rod.

17. The device of claim 15, wherein the ion detecting member is between about 0.5 inches and 5 inches away from the burner.

18. The device of claim 15, wherein the reverse of the electrical signal comprises a direction reversal of at least one of a voltage signal and a current signal.

19. The device of claim 15, wherein the ion detecting member comprises a first ion detecting member and the electrical signal comprises a first electrical signal, the device further comprising a second ion detecting member in the reaction zone, and adapted to generate a second electrical signal in response to a second ion concentration in the reaction zone, and wherein the controller compares the first electrical signal with the second electrical signal.

20. The device of claim 15, further comprising a voltage bias source adapted to generate a voltage bias, wherein the controller compares the biased electrical signal with the electrical signal.

* * * * *